United States Patent [19]

Johnson

[11] 4,437,447

[45] Mar. 20, 1984

[54] EXHAUST RECYCLE TO CARBURETOR OF AN INTERNAL COMBUSTION ENGINE

[76] Inventor: Charles R. Johnson, 543 Robinhood Dr., Aurora, Ohio 44202

[21] Appl. No.: 421,896

[22] Filed: Sep. 23, 1982

[51] Int. Cl.[3] ..... F02M 25/06

[52] U.S. Cl. ..... 123/568; 123/570

[58] Field of Search ..... 123/568, 570, 571

[56] References Cited

U.S. PATENT DOCUMENTS

| | | | |
|---|---|---|---|
| 1,831,470 | 11/1931 | Sherbondy | 123/568 |
| 2,317,582 | 4/1943 | Bicknell | 123/568 |
| 2,589,536 | 3/1952 | Carbonaro | 123/568 |
| 2,643,647 | 6/1953 | Meyer et al. | 123/568 |
| 3,294,073 | 12/1966 | Bressan | 123/568 |
| 3,498,274 | 3/1970 | Chapman | 123/568 |
| 3,730,156 | 5/1973 | Sarto | 123/568 |
| 3,866,585 | 2/1975 | Kopa | 123/568 |
| 4,137,879 | 2/1979 | Kageyama | 123/568 |

FOREIGN PATENT DOCUMENTS

| | | | |
|---|---|---|---|
| 52-52028 | 4/1977 | Japan | 123/568 |
| 55-72643 | 5/1980 | Japan | 123/568 |
| 55-66651 | 5/1980 | Japan | 123/568 |
| 55-78154 | 6/1980 | Japan | 123/568 |

*Primary Examiner*—Wendell E. Burns

*Attorney, Agent, or Firm*—Alfred D. Lobo

[57] ABSTRACT

A hot slipstream from the exhaust of an internal combustion engine is used directly, that is without valving it, to heat and vaporize fuel as it is sprayed from the fuel nozzle of a carburetor having a booster venturi above the throttle plate, provided the ratio of the volume of slipstream to the volume of exhaust gases is self-regulated within narrow limits at all times during the engine's operation, in accordance with the physical considerations governing gas flow. The main jets of a conventional carburetor may be changed to provide decreased flow of gasoline by about 10% to give better mileage without sacrificing performance of the engine, and without adversely affecting the exhaust emissions which are otherwise controlled by a conventional emission control system.

6 Claims, 3 Drawing Figures

EXHAUST RECYCLE TO CARBURETOR OF AN INTERNAL COMBUSTION ENGINE

BACKGROUND OF THE INVENTION

This invention relates to a gasoline fuel system for an internal combustion engine using a down-draft carburetor having a booster venturi (also referred to as an "auxiliary venturi tube") above the throttle valve (throttle plate), and more particularly to the vaporization of gasoline as it issues from the fuel nozzle into the booster venturi within the carburetor.

A conventional fuel system for an internal combustion engine uses a carburetor in which gasoline is sprayed into a stream of air and divided into a profusion of fine droplets or "mist" which is conveyed to the cylinders of the engine where the gasoline is ignited. Though the gasoline is referred to as being "atomized" the droplets are relatively large in comparison with a molecule of gasoline, or a cluster of a few thousand molecules.

When a relatively large droplet is introduced into the cylinder, because of the very short time allowed for combustion, incomplete combustion results. This in turn leads to inefficient engine operation, and to the presence of large quantities of unburned hydrocarbons, carbon monoxide and nitrogen oxides in the exhaust, all to the detriment of the atmosphere.

If the gasoline can be heated sufficiently to behave according to the kinetic molecular theory of matter, gasoline with lower octane rating may be used than would otherwise be required with conventional carburetion. As is well recognized by those skilled in the art, the closer to a true gas the heated gasoline approaches, the more predictable is its volume-temperature-pressure behavior, and correct fuel to air ratios may be maintained in the mixture being ignited in the cylinders of an engine, for better efficiency.

The prior art is replete with attempts to improve vaporization of the gasoline, and include the use of compressed gases, the addition of water or steam under pressure, the use of fuel gas generators where the gasoline is vaporized prior to introduction into a carburetor, and numerous other systems, almost all of which have achieved a notable lack of success.

Examples of fuel gas generators are provided in U.S. Pat. Nos. 4,023,538; 4,050,419; 4,194,476; 4,213,433; and the numerous references cited therein. Illustrative of the advanced state of the art of providing a purely gaseous fuel mixture is the system disclosed in U.S. Pat. No. 3,872,191, which system, like most of the others are so complicated as to be either functionally impractical, or uneconomical, or both. In contrast the device of my invention is the essence of simplicity, yet provides the same functions as the complicated devices.

Exhaust recycle streams, that is, a slipstream taken from the exhaust of an engine and returned to the carburetor, have been used in a variety of different configurations, all with the purpose of improving efficiency and control of the fuel combustion process. For example, U.S. Pat. No. 2,317,582 to G. M. Bicknell discloses an exhaust slipstream recycled to the carburetor above the throttle plate, just below the nozzle through which fuel is injected into the venturi, and he found it necessary to connect the intake and exhaust manifolds of the engine. As will be immediately evident, the valving of the slipstream leads to undue complications, and additionally, the teachings of this reference failed to grasp the significance of the precise location for introducing the slipstream if one is to obtain optimum efficiency without sacrificing the quality of the exhaust emissions.

The shortcomings of the Bicknell system were recognized in U.S. Pat. No. 2,589,536 to M. C. Carbonaro who took an exhaust slipstream and supplied it to a venturi constituting a secondary by-pass which was used in addition to a primary by-pass. The primary by-pass connected a venturi to the lower portion of the body of the carburetor below the throttle plate. Though the valving of the slipstream was avoided, it required that the attenuated velocity of the slipstream be used to provide the forced atomization he sought, and the slipstream did not directly heat the fuel nozzle to accelerate vaporization of the fuel sprayed from it.

Moreover, the '536 patent failed to recognize that an unattenuated slipstream directly into the carburetor would provide a conduit for sparks from the engine and ignite the fuel in the carburetor.

Further, the use of recycled exhaust slipstreams about two decades ago was given scant attention in the subsequent years because of the problems with exhaust emissions. At the present time, a slipstream from the exhaust gases is recycled to an exhaust gas recycle port in the main body of several types of down-draft carburetors but its function is not to heat the booster venturi and the gasoline discharged into and from the booster venturi. Typically, an exhaust gas recycle (E.G.R.) is provided to control emissions by introducing a metered amount of exhaust gas into the carburetor, below the throttle plate, with suitable valving, as for example in the Carter RBS carburetor. The E.G.R. port connects to the primary bore and allows the metered amount of exhaust gas to be fed into the fuel-air mixture. This exhaust emission control system is presently used, most of them with unleaded gasoline, in combination with catalytic mufflers, air pumps, PCV valves, and the like. The present invention may be used in conjunction with any currently used emission control system, including one in which the carburetor has an E.G.R. port, without deleteriously affecting the system's performance. In other words, the present invention is designed for use with a down-draft carburetor fed with a float-controlled gasoline supply, without in any way modifying the emission control system presently used on the internal combustion engine.

SUMMARY OF THE INVENTION

It has been discovered that a hot slipstream from the exhaust of an internal combustion engine may be used directly, that is without valving it, to heat and vaporize fuel as it is sprayed from the fuel nozzle of a carburetor having a booster venturi above the throttle plate, provided the ratio of the volume of slipstream to the volume of exhaust gases is self-regulated within narrow limits at all times during the engine's operation, in accordance with the physical considerations governing gas flow.

It has still further been discovered that it is critical, if gasoline is to be thoroughly vaporized as it leaves the booster venturi of a carburetor, that a self-regulated slipstream, be introduced into the carburetor laterally directly across from the booster venturi which is above the throttle plate of the carburetor. When this is done, the recycled slipstream improves the combustion efficiency of the engine so that the volume of gasoline delivered through the main jets of the carburetor may be decreased about 10 percent to give better mileage without sacrificing performance of the engine, and without adversely affecting the exhaust emissions which are otherwise controlled by a conventional emission control system.

It has more specifically been discovered that an exhaust slipstream, recycled to a carburetor having at least one booster venturi, must be flow-restricted or attenuated with an attenuating means which serves the combined purposes of arresting sparks or flames from the exhaust, and also decreases the velocity of the exhaust slipstream and lowers its pressure, just before it enters the carburetor. Within the narrow volumetric ratio of slipstream to the engine's exhaust gases, the hot exhaust gas recycle to the booster venturi is effective because it is surprisingly self-regulated once the pressure drop for any specific rate of flow of gas through the attenuator means and the supply conduit for the slipstream is chosen and fixed.

It is therefore a general object of this invention to provide essentially complete vaporization of fuel discharged from a fuel nozzle in a booster venturi into a down-draft carburetor by first flowing an unvalved but attenuated slipstream of more than 2% but less than 10% of an internal combustion engine's exhaust gases through a baffled or otherwise gas-flow-restricting or attenuator means which provides the dual function of gas velocity attenuator and heat exchanger; and, then introducing the slipstream into the carburetor directly across from the booster venturi and above the throttle plate.

BRIEF DESCRIPTION OF THE DRAWINGS

The foregoing and other objects and advantages of my invention will appear more fully from the following description, made in connection with the accompanying drawings of preferred embodiments of the invention, wherein like reference characters refer to the same or similar parts throughout the several views and in which.

DETAILED DESCRIPTION OF PREFERRED EMBODIMENTS

Figure 1:
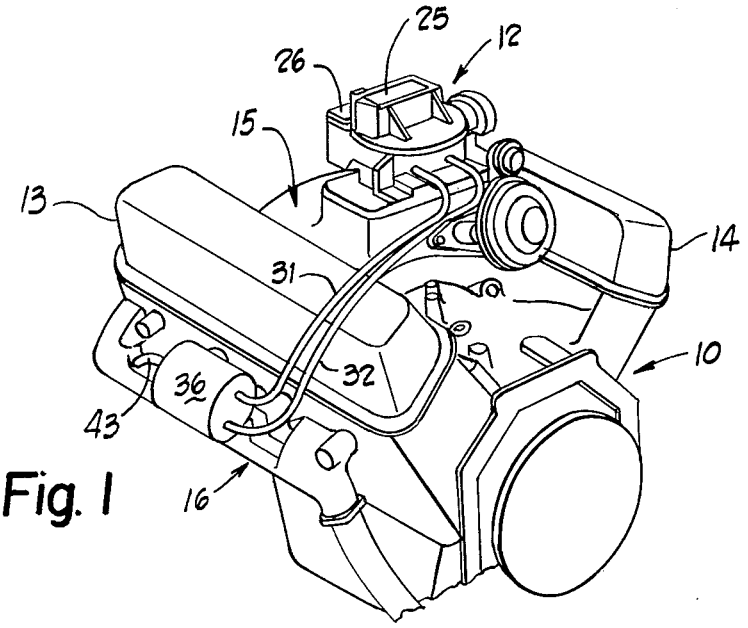
FIG. 1 is a perspective view schematically illustrating a V-8 engine which utilizes a down-draft float-controlled carburetor improved by the device of this invention.

Referring to the drawings, and in particular to FIG. 1, there is shown a perspective view schematically illustrating a V-8 engine indicated generally by reference numeral 10, having intake and exhaust manifolds, 15 and 16 respectively, a down-draft carburetor indicated generally by reference numeral 12, which includes a reservoir or bowl 26 in which the level of gasoline is float-controlled, and the device of this invention, indicated generally by reference numeral 30, for introducing exhaust gas into the carburetor.

In the detailed description hereinbelow the manner and process of making and using the device of the invention will be described in such full, clear, concise and exact terms as to enable any person skilled in the art to make and use the same, and sets forth the best mode of the invention, without referring in detail to those mechanical parts of an engine, and their function, which are conventional, and which parts would serve their same purpose in this invention, assuming they are used, as they ordinarily serve.

Accordingly, it is assumed that the conventional engine 10 will be used, which engine is supplied with fuel by a conventional down-draft, float-controlled carburetor 12. In the specific illustration the carburetor 12 is located approximately centrally above the engine intermediate its valve covers 13 and 14. A V-8 engine will conventionally have an exhaust manifold on each side, one of which exhaust mainfolds 16 provides the hot recycle slipstream for this invention. If desired, each exhaust manifold may provide a slipstream to the carburetor, particularly where the carburetor is a four-barrel type. In other engines, particularly smaller engines having four or six cylinders, the carburetor may be mounted on the side of the engine, and the intake manifold 15 of the engine will typically be positioned directly above the exhaust manifold 16 to benefit from the heat generated therewithin.

Figure 2:
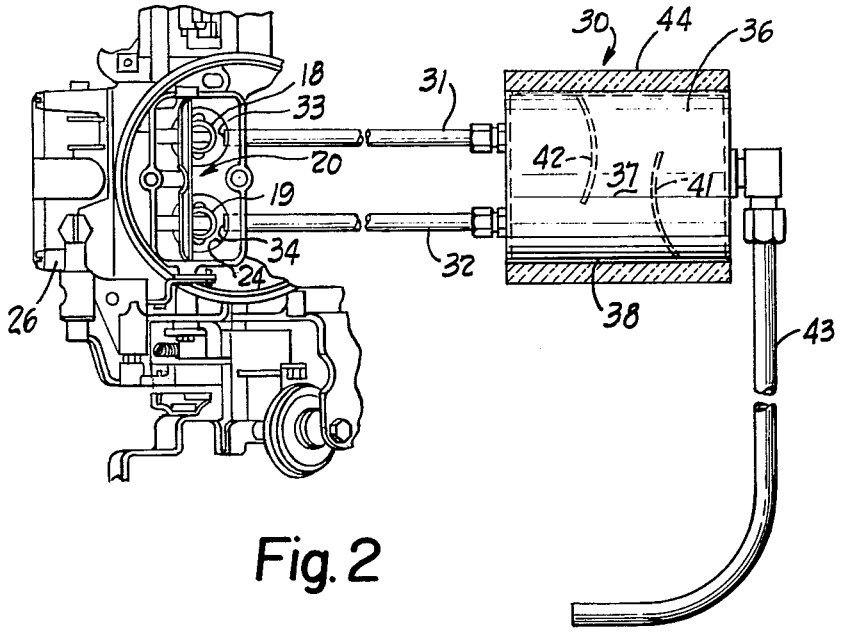
FIG. 2 is a plan view of a typical dual-main venturi ("two-throat" or "two-barrel") carburetor in which an attenuated unvalved exhaust gas recycle is provided.
Figure 3:
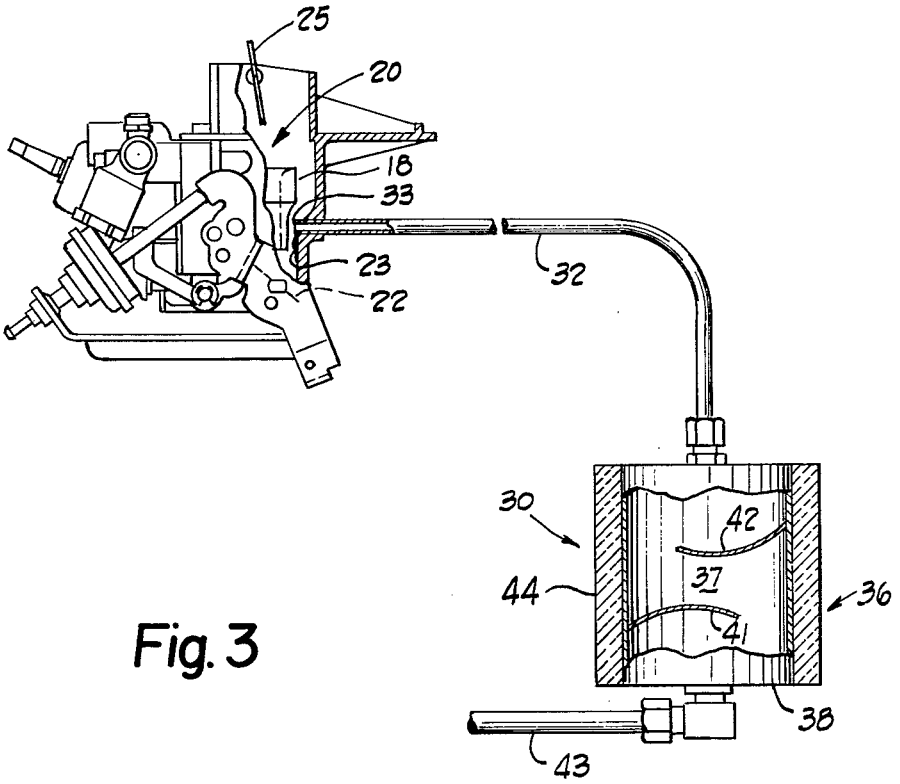
FIG. 3 is an elevational cross sectional view diagramatically illustrating (a) the precise location of the exhaust gas recycle relative to the booster venturi of the carburetor, and (b) with a portion broken away, the attenuating means including baffle means therewithin (turned 90° from its Position in overlying contact with the exhaust manifold, as shown in FIG. 1, for clarity of illustration).

As will presently be evident, for the purposes of this invention, referring now to FIG. 2, the carburetor 12 is necessarily of the type in which booster venturi, indicated generally by reference numerals 18 and 19, assist in providing a finely divided spray (mist) of gasoline to the engine.

There may be only a single booster venturi if a single-throat carburetor is used, or if plural throats are used, a second, third and fourth booster venturi are provided so there is one for each throat. In the illustration, a two-throat ("two-barrel") carburetor is illustrated, having one booster venturi for each throat, as for example in carburetors presently manufactured by Carter, Holley, Motorcraft, Toyo Kogyo, Nippon and the like, and in general use on current model automobiles.

The booster venturi 18 and 19 are generally formed integrally with a cluster casting 20, including idle tubes, main well tubes, primary idle air bleeds, and the like (not specifically identified), all of which are conventional. The booster venturi 18 is necessarily located above the throttle plate 22 (shown in dotted outline) of the carburetor, which throttle plate is pivotably disposed below the constriction 23 of the main venturi 24 within the body of the carburetor. A choke plate 25 is pivotably disposed above the booster venturis.

Gasoline is supplied from the float-controlled bowl 26 to fuel nozzles (not shown) in the cluster casting 20, is atomized as droplets from passages circumferentially located within the upper portion of the body of the booster venturi, and is then sucked down into the intake manifold through the main venturi, and thence ducted to each of the cylinders of the engine.

As will be seen in FIG. 2, each of the two throats (main venturis) of the carburetor is provided with supply conduit means (supply lines) 31 and 32 respectively, through each of which a slipstream of exhaust gas is recycled. The outlet 33 of supply line 31, and outlet opening 34 of supply line 32, are positioned so that they are laterally directly oppositely disposed relative to the booster venturis 18 and 19 respectively.

This positioning is critical as it is essential that the maximum amount of heat from the exhaust gas recycle stream be transferred to the booster venturis, to heat them and vaporize the gasoline to a gaseous state approaching that in which the gasoline vapor obeys the laws of gases. Moreover, it has been found, experimentally, that if an outlet for a slipstream is located above the booster venturi the effectiveness of the slipstream is vitiated; and if the outlet of a supply line is below the booster venturi, the turbulence imparted to the gasoline issuing from the booster venturi adversely affects the efficiency of the engine. Thus, it is only when a slipstream from a supply line directly heats a booster venturi, and the outlet of the supply line is positioned so that the side of a booster venturi is substantially uniformly heated because it is directly opposite from each outlet, that the improved efficiency of the engine will be best attained.

The criticality of the positioning of the slipstream is enhanced because of the limited volume of exhaust gas which can be recycled to the carburetor without adversely affecting the engine's operation. This volume is critically controlled and self-regulated by the engine's operation because the carburetor is in unvalved but attenuated flow-communication with the exhaust manifold of the engine. Since there is no valving between the carburetor and the exhaust manifold, but only a preselected fixed resistance to flow, the volume of the slipstream to the carburetor is controlled directly by the laws controlling the flow of gases, and is a function of the pressure and temperature of the exhaust gases in the manifold, and the dynamic variation in pressure-drop which occurs between the exhaust manifold and the carburetor under varying conditions of operation of the engine.

The precise self-regulated flow of an optimum amount of slipstream exhaust recycle to each booster venturi is obtained with the device of this invention which comprises an attenuator means 36 including an attenuator chamber 37 defined by a cylindrical body 38 fitted with baffles 41 and 42 which serve to attenuate the velocity, that is, restrict gas flow and decrease the pressure of the exhaust gases entering the attenuator chamber through an intake conduit means (attenuator intake line) 43, and to arrest any spark which might prematurely ignite gasoline in the carburetor.

The degree of baffling will determine the restriction to flow, such baffling being fixed. However, the pressure drop due to the restriction is not constant but changes with engine operating conditions, since the volume, temperature and pressure of gases in the exhaust manifold vary. The changing pressure drop determines the velocity and volume of a slipstream impinging upon the booster venturi. This surprising self-regulation, particularly when it is realized due to increased pressure drop through the attenuator means during the engine's cruising operation in the range of from about 2000–4000 rpm, is highly effective and provides the precise amount of recycled exhaust gas to the booster venturi under all operating conditions of the engine. The amount of flow-restriction desirable will vary from one engine to another having a different displacement, or for those having different cylinder configurations for the same displacement, or for those having a carburetor with booster venturis of different size and geometry, but this amount will be readily arrived at with a little experimentation.

It is not critical that baffles be used, and they may be substituted with ceramic wool, or ceramic saddles, or perforated tubes such as those commonly used in automotive muffler construction, and the like. Baffles are most preferred as they are less prone to be fouled by contaminants in the exhaust gas.

The attenuator 36 is preferably positioned in heat-receiving relationship with the exhaust manifold so that the temperature of the slipstream is maintained as nearly equal to that of the exhaust gases as possible. It is preferable to place the attenuator in overlying contact with the exhaust manifold and to provide insulation means 44, such as glass wool, to aid in conserving heat transferred from the exhaust manifold to the attenuator. For effective operation, the temperature of the slipstream is preferably not more than 300° F. lower (cooler) than, and more preferably, not more than 200° F. lower than that of the exhaust gases in the manifold from which the slipstream is taken.

The cross section of the chamber 37 and its volume is not critical, but what is critical is the amount of exhaust gases the combined slipstreams (from the supply lines 31 and 32) deliver to the carburetor. Since the throat of the carburetor is in unvalved but restricted open flow communication with the exhaust manifold, it is most practical to determine and set the cross-section of the intake line 43 so that, with any preselected baffle means and the pressure drop due thereto, the combined volume of exhaust gas in the slipstreams to the carburetor is always more than 2 percent but less than 10 percent, and preferably between 3% and 7%, of the volume of the exhaust gases generated by the engine.

The cross-sectional area of each of the supply lines 31 and 32 from the attenuator to the carburetor is derived from that of the intake 43, since the preselected pressure drop through the attenuator chamber 37 is relatively small at idle, and at low engine rpm in the range from about 550–1200 rpm, or at running speeds even as high as about 1500 rpm. It is most practical to have the combined cross-sectional areas of the supply lines 31 and 32 equal to that of the cross-sectional area of the intake 43, when the attenuator is baffled as illustrated with oppositely disposed arcuate sheet metal baffles. For a 400 cubic inch engine the intake line 43 is most preferably ½" (0.5 inch) nominal diameter steel tubing, and the supply lines are each ¼" (0.25 inch) nominal diameter tubing, so that with each baffle having an area greater than one-half the cross-sectional area of the attenuator chamber, as illustrated, about one-sixteenth (6.25 percent) of the exhaust gases from the engine are recycled to the carburetor. Where there is only one supply line to a single throat carburetor, the cross-sections of the supply line and the intake line will preferably be equal.

It will now be evident to one skilled in the art that it is most desirable to provide the attenuator chamber with a baffle means which is resistant to fouling, thus relying in large measure on the ratio of the diameters of the supply line and intake conduit to assist in providing the requisite attenuation, though theoretically, substantially all the requisite attenuation may be provided with an appropriate choice of baffle means. It has also been found that, for internal combustion engines having a displacement in the range from about 1.5 liters to about 2.5 liters the intake conduit preferably has a diameter in the range from about 0.25" to about 0.5", and for displacements in the range from about 2.5 liters to about 7 liters, each intake line preferably has a diameter in the range from about 0.375" to about 0.75".

An engine fitted with the device of this invention has provided surprisingly high mileage, at least 25 percent higher than that obtained without the device, without adversely affecting the operation of the engine in any manner. In particular, it has been found that the device of this invention allows excellent cold starts, hot starts, acceleration, and the like, so as to discharge all the several functions of a well-performing carburetor. The following test results are indicative of the improvement in engine operation attributable to the device of this invention.

EXAMPLE

For illustrative purposes, a large V-8 engine having a displacement of 400 cu. ins. on a 1977 model Ford LTD equipped with a Motorcraft Series 2100 two-barrel carburetor fitted with standard No. 65 jets (for unleaded gasoline), was used.

The engine was tuned, that is, fitted with new spark plugs, and the charging circuit, alternator pattern, initial timing and advance system timing were all checked to ensure optimum normal operation of the conventional carburetor and engine, that is, before they were fitted with the exhaust recycle means of this invention. The conventional engine was then run at a fixed normal load.

The engine was again tuned to the same specifications as before, except the stock gasoline jets were replaced with No. 55 jets which provided 10% less gasoline than the stock jets under equivalent engine operation conditions. Even leaner jets, up to about 20% leaner, may be used, but for overall operation of the engine in all ranges, a range of about 5% to about 15% leaner than stock jets is most preferred.

The carburetor was then further modified to embody the device of this invention. Two through-passages were drilled into the body of the carburetor into which 0.25" diameter supply lines were fitted in fluid-tight engagement. The outlets of the supply lines were each positioned directly opposite each of the booster venturis, and were above the throttle plates of each main venturi of the carburetor. No alteration of any kind was made to any of the original emission control components of the engine, nor to the catalytic muffler on the car.

A cylindrical metal chamber about 4" in diameter and about 5" long was constructed from sheet metal and fitted with arcuate baffles each having an area about 75% of that of the cross-sectional area of the chamber, which baffles were welded into the chamber so as to deflect the exhaust gases from the intake line around the inside of the chamber before they are ducted through the supply lines. The intake line to the chamber is 0.5" diam. steel tubing. All connections are made with pressure fittings, as illustrated in the Figs, and the exhaust manifold, carburetor, and attenuator are appropriately adapted to receive the necessary components of the pressure fittings.

The attenuator was placed upon the exhaust manifold in contact therewith, and shrouded with glass fiber mat so as to envelop both the attentuator and the exhaust manifold, thus effectively to transfer heat from the exhaust manifold to the attentuator, and to maintain it, as nearly as possible, at the same temperature as the exhaust manifold. A through-passage is drilled in the exhaust manifold and the intake line fitted in the passage, in fluid tight engagement therewithin with compression fittings, or the like and the line is preferably insulated.

The attenuation of pressure drop due to the baffling is such that the pressure in the supply line, at a point adjacent the carburetor, is at least 70% of the pressure in the exhaust manifold of the engine when it is operating in the range from about 550–850 rpm. The precise optimum attenuation of pressure will vary for different engines, but it is found that generally baffling should not be so severe at idling conditions as to produce too great a pressure drop through the attenuator.

Except for cold starting conditions, it is found that the slipstream of hot exhaust gases will heat the gasoline flowing from the booster venturi so that the gasoline from the booster venturi will be at a temperature higher than 200° F., the upper limit of temperature always being below the ignition temperature of the gasoline. The temperature may be raised as high as 650° F. under strenuous operation of the engine, though for conventional operating ranges the temperature will range between 250° and 600° F.

The engine and carburetor modified as described hereinabove was again run under the same fixed normal load as previously. It was found that fuel consumption was improved more than 25%.

Analysis of exhaust emissions from the exhaust manifold was made by sampling from a tee-fitting in the intake line to the attenuator, to determine what effect the device of this invention has upon the levels of unburned hydrocarbons, of CO, of nitrogen oxides, and of oxygen in the exhaust. The analysis was a typical Allen test conducted with a Smart Scope analyzer made by the Allen Group, Inc. Model No. 92-390 Serial No. DIJ-50151, which had recently been certified. It was found that allowable HC emissions had been decreased, the improvement being better than 25%. The CO level in the exhaust had also been decreased by more than 25%, indicating more complete combustion than with the conventional carburetor and engine. No analysis for NO, $NO_2$ and the like was made.

From the foregoing analysis, it is evident that the device of this invention allows the engine to perform normally with less gasoline flowed to the carburetor than usually required, and shows improved combustion efficiency without adversely affecting exhaust emissions.

I claim:

1. In an internal combustion engine having an exhaust manifold, and a float-controlled down-draft carburetor including a booster venturi means for injecting gasoline into the carburetor wherein said booster venturi is positioned above the throttle plate of the carburetor, the improvement comprising, (a) an attenuator means which places said exhaust manifold in unvalved but restricted open fluid communication with said exhaust manifold, said attenuator means comprising,
  (i) an attenuator chamber, and
  (ii) baffle means within said chamber to attenuate the velocity and lower the pressure of exhaust gases in said exhaust manifold, (b) intake conduit means of predetermined diameter to place said chamber in open fluid communication with said exhaust manifold, and, (c) supply conduit means of predetermined diameter placing said chamber in open fluid communication with said carburetor, the outlet of said supply conduit being positioned directly laterally opposite from said booster venturi so as to heat it by directly impinging recycled exhaust gases thereupon, the amount of said recycled gases to the carburetor being greater than 2 percent but less than 10 percent by volume of exhaust gases generated by said engine.

2. The combination of claim 1 wherein said directly impinging recycled exhaust gases are more than 2% but less than 10% by volume of said exhaust gases generated by said engine at substantially all times during operation thereof.

3. The combination of claim 2 wherein said baffle means is effective to restrict the flow of said recycled exhaust gases so that pressure in said supply line is at least 70% of the pressure in the exhaust manifold of an engine operating in the range from about 550–850 rpm.

4. The combination of claim 2 wherein the temperature of said recycled exhaust gases is not more than about 300° F. lower than that of said exhaust gases in the manifold from which said recycled exhaust gases are taken.

5. The combination of claim 2 wherein gasoline issuing from said booster venturi is heated to a temperature in the range from about 200° F. to about 650° F.

6. A method of controlling operation of an internal combustion engine by controlling the temperature of gasoline sprayed into the main venturi of a carburetor having a booster venturi, and controlling the amount of exhaust gases recycled to the carburetor, comprising, (a) conducting a self-regulated slipstream of said exhaust gases, in an amount from about 2% to 10% by volume of the exhaust gases generated by said engine, to said carburetor which is disposed in unvalved but restricted open fluid communication with an exhaust manifold of said engine, so that the pressure of said slipstream adjacent the carburetor is at least 70% of the pressure in said exhaust manifold when the engine is operating in the range from about 550–850 rpm, (b) directly heating said booster venturi by impinging said self-regulated slipstream at the center of said booster venturi, so as to maintain the temperature of the gasoline vapor flowing into said main venturi at a temperature in the range from about 200° F. to about 650° F., and (c) diluting the air flowing through said carburetor with said slipstream so as to maintain the exhaust emissions of said engine within predetermined limits.

* * * * *